US005993025A

United States Patent [19]

Huang

[11] Patent Number: 5,993,025

[45] Date of Patent: Nov. 30, 1999

[54] FIGURE LIGHT

[75] Inventor: Peter K. H. Huang, Taipei, Taiwan

[73] Assignee: Shining Blick Enterprises Co., Ltd., Taipei, Taiwan

[21] Appl. No.: 09/286,939

[22] Filed: Apr. 7, 1999

[30] Foreign Application Priority Data

Mar. 11, 1999 [CN] China ..... 99 2 05542

[51] Int. Cl.[6] ..... F21V 21/08

[52] U.S. Cl. ..... 362/249; 362/396; 362/806

[58] Field of Search ..... 362/249, 252, 362/382, 396, 806, 807, 808

[56] References Cited

U.S. PATENT DOCUMENTS

| | | | |
|---|---|---|---|
| 4,884,178 | 11/1989 | Roberts | 362/249 |
| 4,999,755 | 3/1991 | Lin | 362/250 |
| 5,873,651 | 2/1999 | Hofer et al. | 362/396 |

*Primary Examiner*—Y. Quach
*Attorney, Agent, or Firm*—Dougherty & Troxell

[57] ABSTRACT

A figure light, which includes a figured support having an inner rail, an outer rail and a plurality of locating blocks connected in parallel between the rails, and a plurality of elastic lamp sockets respectively fastened to the locating blocks to hold a respective bulb, the lamp sockets each a hook respectively hooked on the locating blocks.

3 Claims, 6 Drawing Sheets

FIGURE LIGHT

BACKGROUND OF THE INVENTION

The present invention relates to a figure light, in which the lamp socket of each of the lights has a hook for quick installed in a respective locating block between an inner rail and outer rail of a figured support.

In certain holidays, decorative strings and light sets may be hung on trees, buildings, etc. and operated to produce a lighting effect at night. Recently, net lights, knitting lights and figure lights have been intensively used instead of conventional decorative strings and light sets. Net lights and knitting lights are relatively expensive. Figure lights are less expensive, and can easily made subject to the desired pattern. A regular figure light is generally comprised of a figured support, and a plurality of lights installed in the figured support. The figured support is a flat board injection-molded from plastics subject to the desired shape, for example, a tree, star, or Santa Claus, having a plurality of mounting through holes. The plastic lamp sockets of the lights are respectively press-fitted into the mounting through holes at the figured support. Because the lights are fastened to the figured support simply by inserting the respective plastic lamp sockets into the mounting through holes at the figured support, the lights tend to be forced away from the figured support.

SUMMARY OF THE INVENTION

The present invention provides a figure light which comprises a figured support, and a plurality of lights fastened to respective locating blocks between an inner rail and an outer rail of the figured support. The lights each comprise an elastic plastic socket having a hook for fastening to one locating block at the figured light, and a bulb installed in the elastic plastic socket. By means of the hook at the elastic plastic socket of each light, the lights can be quickly and positively installed in the figured support.

DETAILED DESCRIPTION OF THE PREFERRED EMBODIMENT

Figure 1:
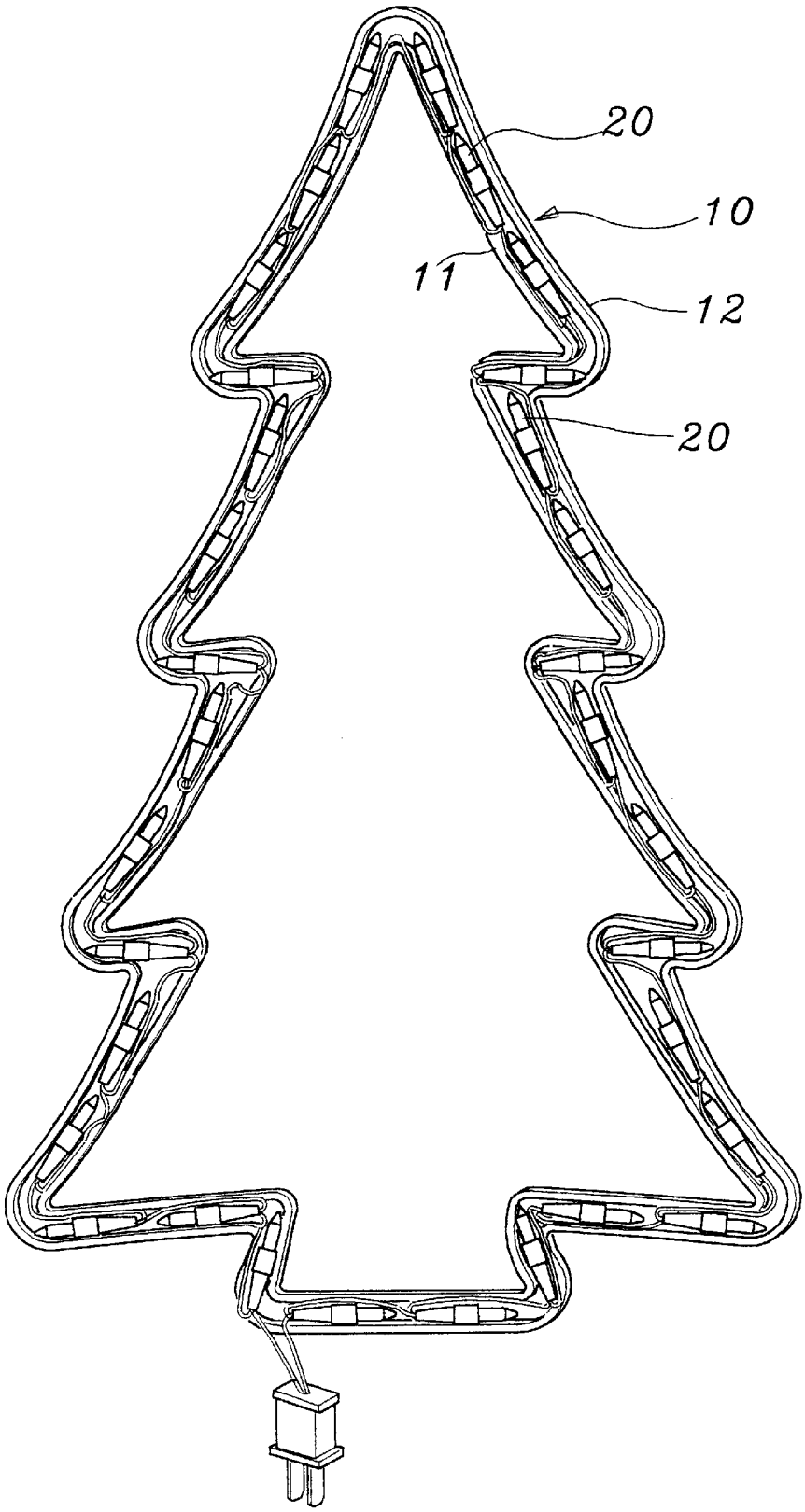
FIG. 1 is a front view of a figure light according to the present invention.
Figure 2:
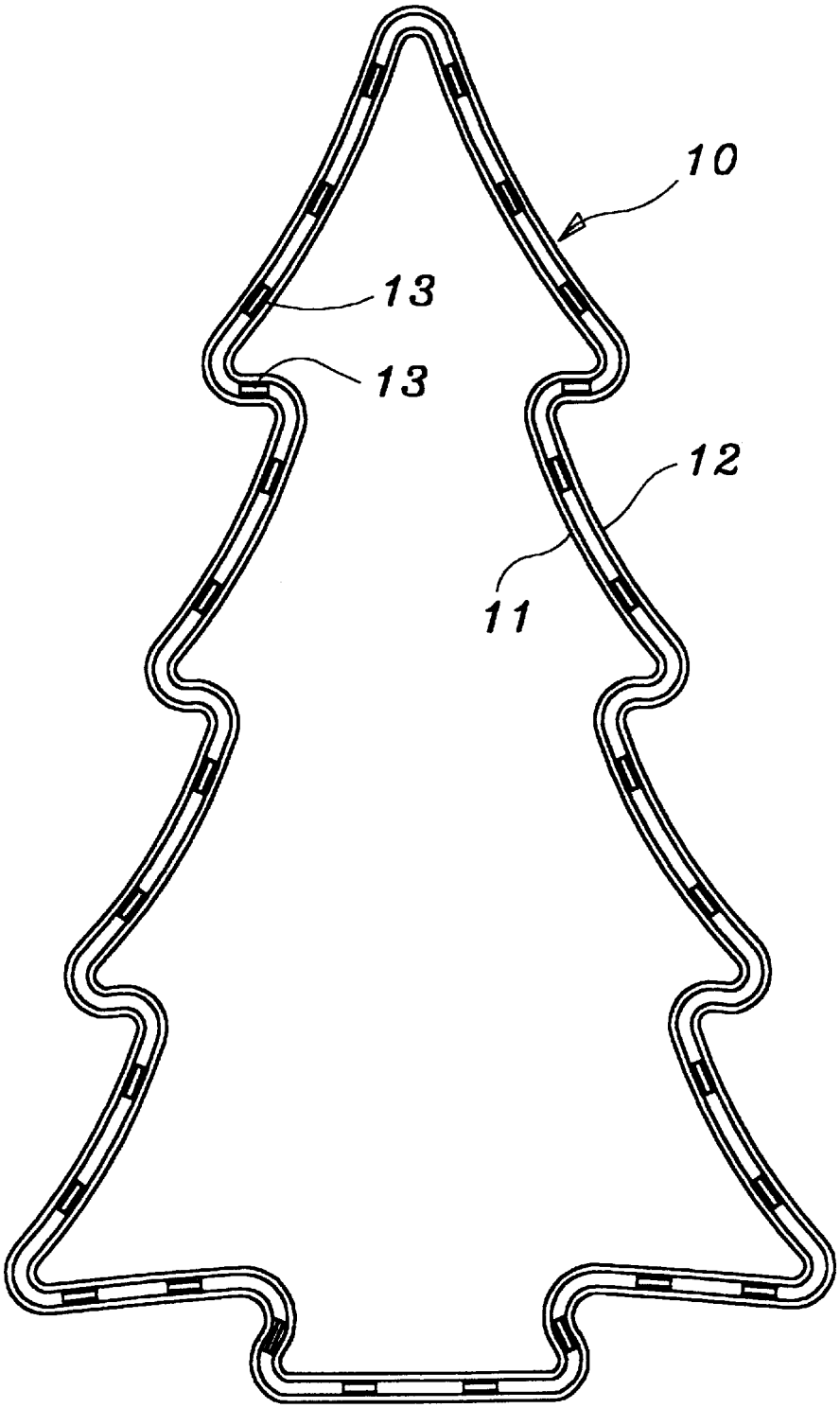
FIG. 2 is a back side view of the figured support for the figure light shown in FIG. 1.

Referring to FIGS. 1 and 2, a figure light is shown comprised of a figured support 10, and a plurality of lights 20 mounted in the figured support 10. The figured support 10 is comprised of an inner rail 11, an outer rail 12, and a plurality of locating blocks 13 connected in parallel between the rails 11 and 12. The thickness of the locating blocks 13 is preferred not thicker than the rails 11 and 12.

Figure 3:
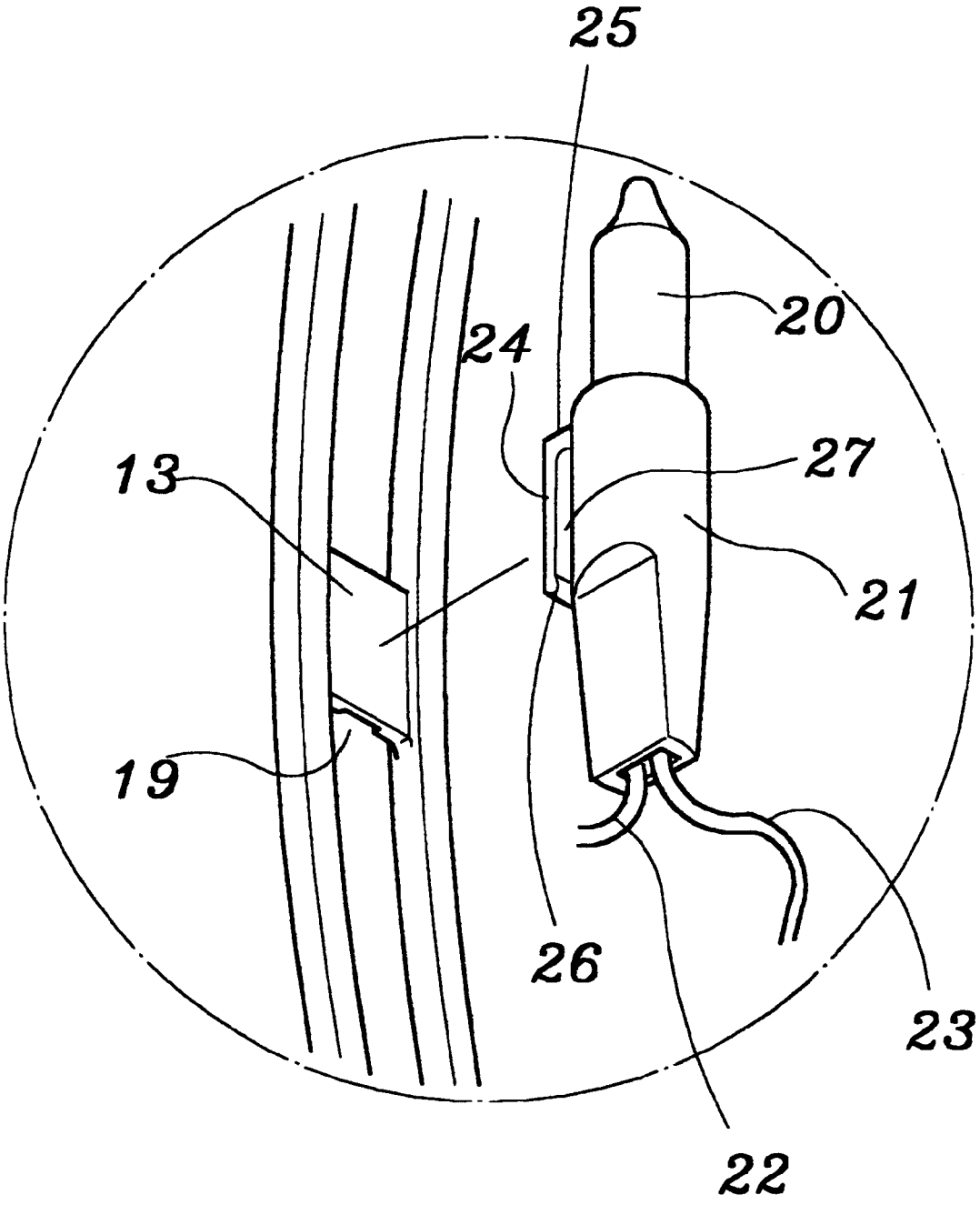
FIG. 3 is an exploded view of a part of the present invention.
Figure 4:
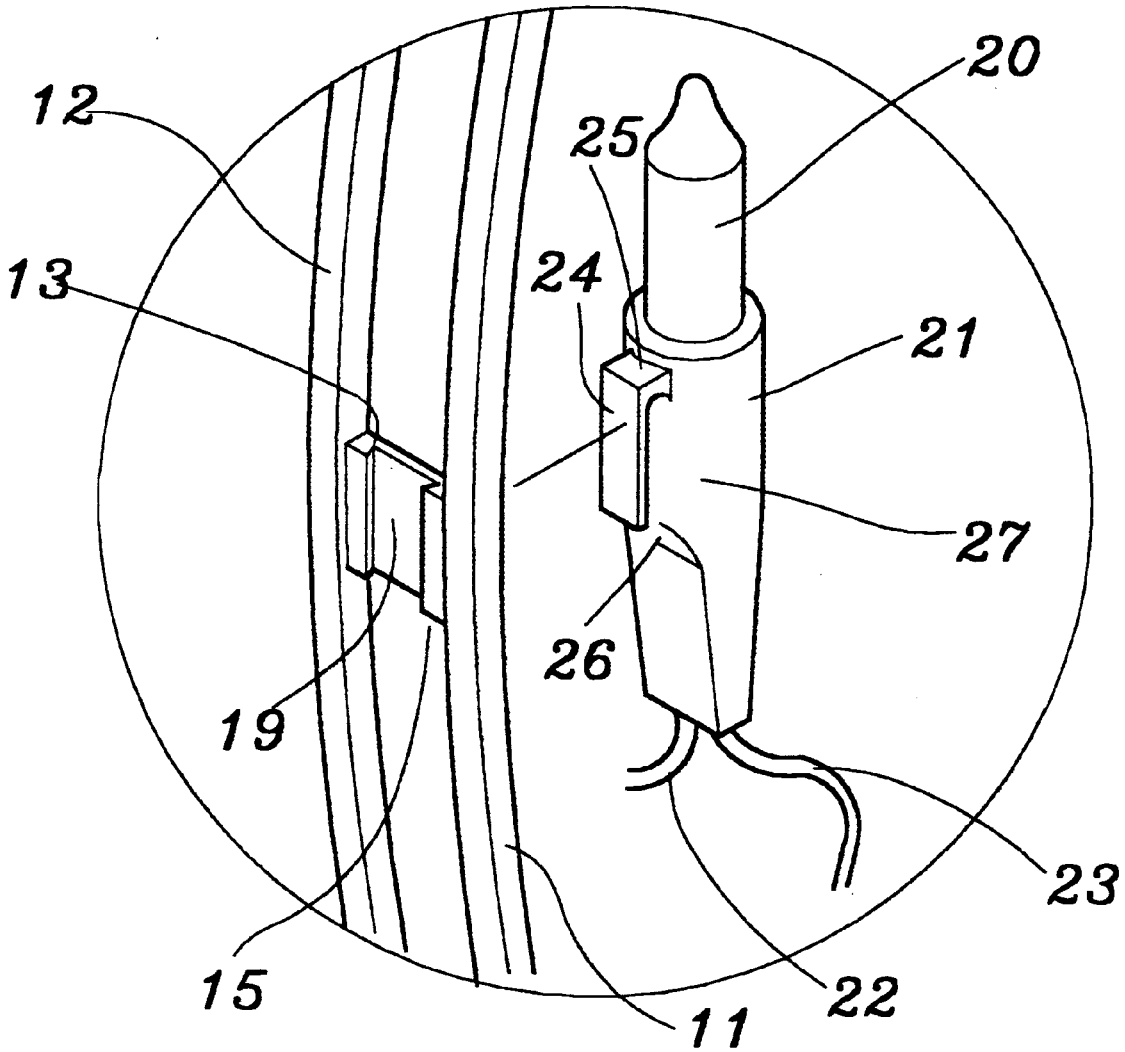
FIG. 4 is a back side view of FIG. 3.

Referring to FIGS. 3 and 4, the light 20 comprises a flexible plastic lamp socket 21 holding a bulb, and two lead wires 22 and 23 extended out of the lamp socket 21 for connection to power supply. The lamp socket 21 comprises a hook 24 raised from the periphery thereof for fastening to the locating block 13. The hook 24 has an angled fixed end formed integral with the periphery of the lamp socket 21, and a hooked free end 26. A gap 27 is defined between the periphery of the lamp socket 21 and the hook 24. The locating block 13 comprises a groove 19 at its one side through its vertical length.

Figure 5:
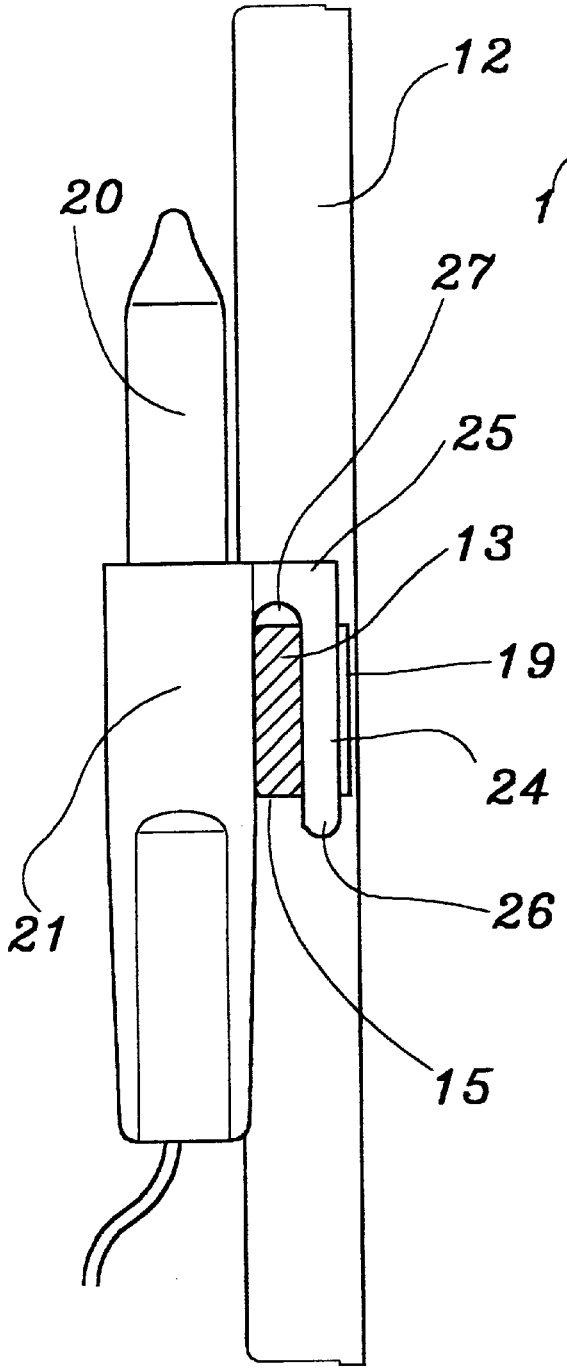
FIG. 5 is a sectional view of the assembly of FIG. 4.
Figure 6:
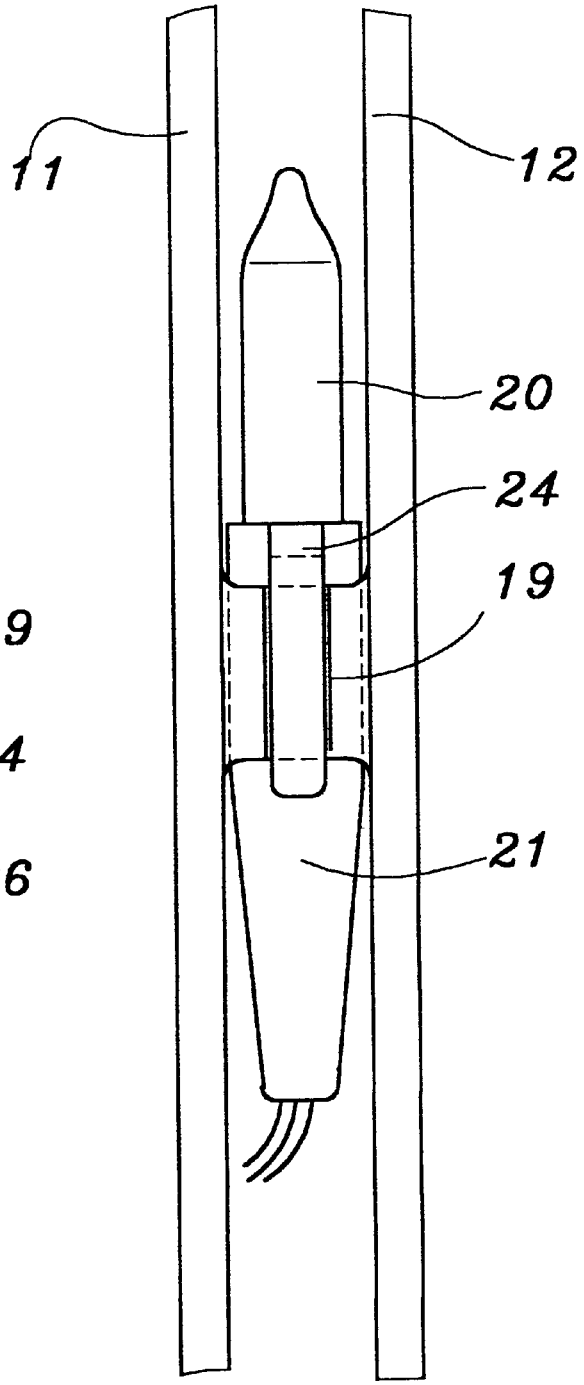
FIG. 6 is a back side view of FIG. 5.

Referring to FIGS. 5 and 6, the hook 24 is slightly bent outwards and then hooked into the groove 19 at the locating block 13, permitting the locating block 13 to be fitted into the gap 27. After installation, the bulb of the light 20 is suspended between the rails 11 and 12. When the light 20 is operated, the lighting effect of the light 20 can be seen from the front side as well as the back side of the figure light.

Figure 7:
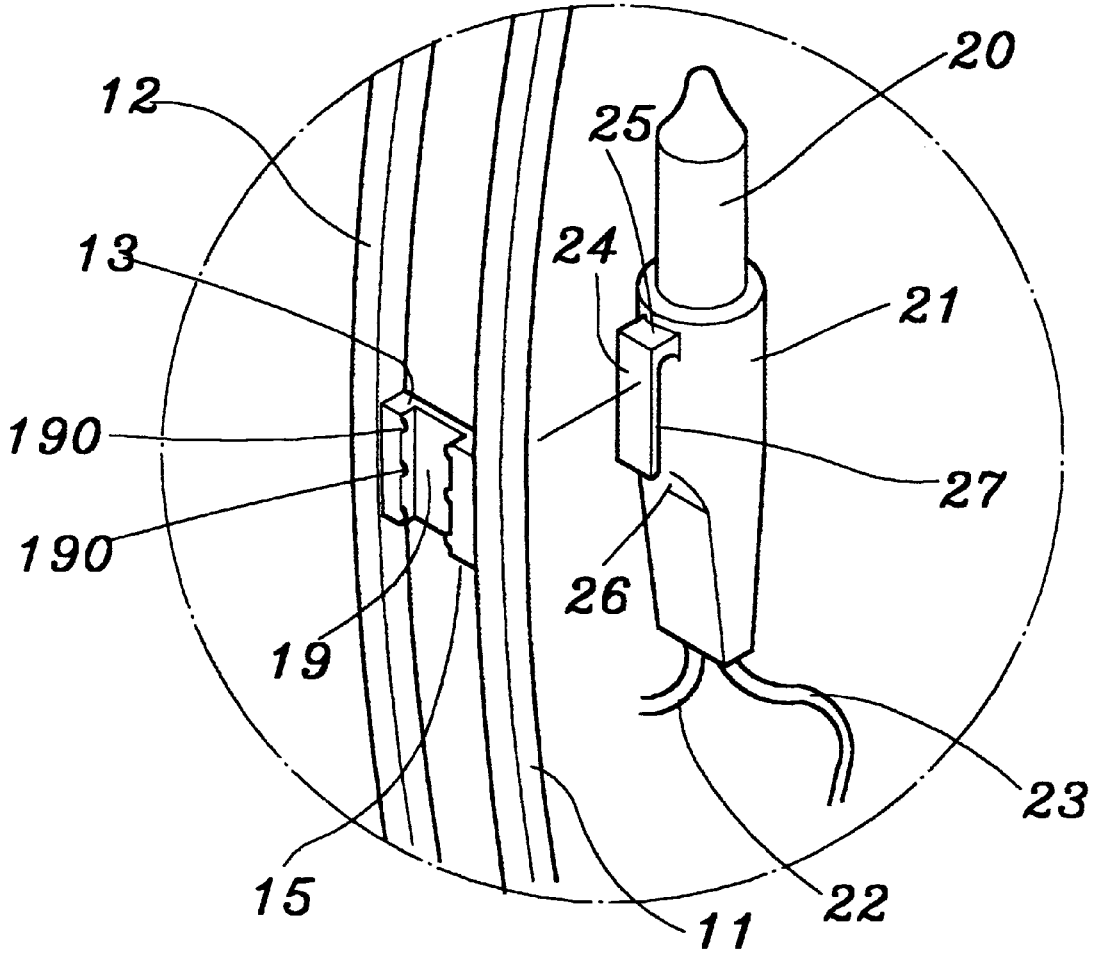
FIG. 7 is an exploded view of a part of an alternate form of the present invention.

FIG. 7 shows an alternate form of the present invention. According to this alternate form, the locating block 13 comprises a plurality of retaining portions 190 disposed at two opposite sides of the groove 19 for securing the hook 24 of the light 20 in place.

It is to be understood that the drawings are designed for purposes of illustration only, and are not intended as a definition of the limits and scope of the invention disclosed.

What the invention claimed is:

1. A figure light comprising:

a figured support, said figured support comprised of an inner rail, an outer rail, and a plurality of locating blocks connected in parallel between said inner rail and said outer rail; and a plurality of elastic lamp sockets respectively fastened to said locating blocks of said support to hold a respective bulb, each of said lamp sockets comprising a hook respectively hooked on each of said locating blocks in said inner and outer rail.

2. The figure light of claim 1 wherein each of said locating blocks comprises a back groove for connecting to the hook of one of said lamp sockets, said back groove having a width fitting a width of the hook of each of said lamp sockets.

3. The figure light of claim 2 wherein each of said locating blocks comprises a plurality of retaining portions disposed at two opposite sides of the respective back groove.

* * * * *